United States Patent [19]

Pouillon

[11] 4,246,097

[45] Jan. 20, 1981

[54] METHOD AND DEVICE FOR SEPARATING PARTICLES SUSPENDED IN A LIQUID BY GUIDING THESE PARTICLES THROUGH A MAGNETIC FIELD

[75] Inventor: Emile R. J. Pouillon, Lasne, Belgium

[73] Assignee: Société Anonyme Cribla, Brussels, Belgium

[21] Appl. No.: 7,575

[22] Filed: Jan. 29, 1979

[51] Int. Cl.[3] ..... B03C 1/12

[52] U.S. Cl. ..... 209/214; 209/223 R; 209/232

[58] Field of Search ..... 209/38–39, 209/213, 214, 222–223 R, 222–223 A, 225–228, 231–232, 219; 210/222–223

[56] References Cited

U.S. PATENT DOCUMENTS

| | | | |
|---|---|---|---|
| 2,416,746 | 3/1947 | Gavin | 209/214 |
| 3,690,454 | 8/1972 | Bekhtle et al. | 209/38 |

FOREIGN PATENT DOCUMENTS

| | | | |
|---|---|---|---|
| 2749661 | 5/1978 | Fed. Rep. of Germany | 209/223 A |
| 573192 | 9/1977 | U.S.S.R. | 209/223 A |
| 588001 | 1/1978 | U.S.S.R. | 209/232 |

*Primary Examiner*—Ralph J. Hill
*Attorney, Agent, or Firm*—John P. Snyder

[57] ABSTRACT

A method and device for separating particles suspended in a liquid by guiding these particles through a bed of balls of ferro magnetic material and by moving these balls together with the particles through a magnetic field, by supplying a washing liquid during the passage of the particles through the magnetic field for washing off the non-magnetic particles and by supplying a liquid outside the magnetic field for discharging the magnetizable particles. After leaving the magnetic field the balls and the magnetizable particles fall freely over some distance.

15 Claims, 2 Drawing Figures

Figure 1:
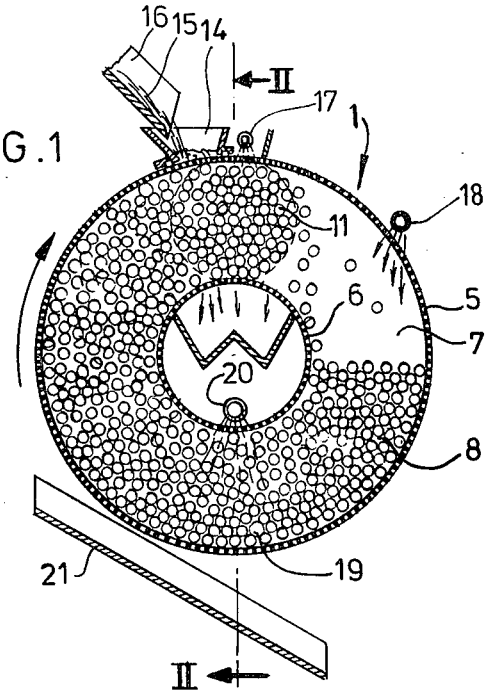

METHOD AND DEVICE FOR SEPARATING PARTICLES SUSPENDED IN A LIQUID BY GUIDING THESE PARTICLES THROUGH A MAGNETIC FIELD

The invention relates to a method for separating particles suspended in a liquid by guiding these particles through a magnetic field, by supplying a washing liquid during the passage of the particles through the magnetic field for washing off the non-magnetic particles and then supplying a liquid outside the magnetic field to the particles for discharging the magnetisable particles, the particles to be separated being quided through a bed of balls of ferromagnetic material.

The known method has the disadvantage that the magnetic particles as a consequence of remanent magnetism remain sticking to the balls of ferromagnetic material and that it is difficult to make the particles free from the balls after leaving the magnetic field.

The invention has for its aim to provide a method which does not show this disadvantage.

According to the invention one makes the balls and the magnetisable particles after leaving the magnetic field freely fall over some distance. As a result of the disturbance of the configuration of the balls the remanent magnetism is eliminated and neutralized. Moreover one has the advantage that as a result of the change of the position of the balls in relation to each other the washing liquid can reach parts of the surface of the balls which in the previous position of the balls in relation to each other were covered.

The invention also relates to a device for performing the above method.

According to the invention such a device consists of one or more ring-like chambers which are mounted for rotation around an axis and which locally pass between the poles of a magnet, said chambers containing balls of ferromagnetic material and said chambers being provided with supplies for the material to be separated and for the washing liquid and with collecting means for collecting the washing liquid and the particles therein.

According to the invention the axis of the rotating ring like chambers encloses an angle with the vertical direction, the magnetic poles are situated near the highest point of the chambers, under the lower part of the ring-like chambers and under the portion of the chambers lying between the magnetic poles one or more collecting troughs have been provided and the ring-like chambers are only partly filled with balls, such that upon rotation the balls are stowed between the magnetic poles and upon leaving the space between the magnetic poles the balls are falling freely downwards. Such it is realised easily that the balls with the magnetic particles after leaving the magnetic field fall freely downwards, so that the configuration is disturbed and the remanent magnetism is eliminated, as a result of the change in the direction of the magnetic particles and the balls in relation to each other. As a consequence it is possible to wash off completely or substantially completely the magnetisable particles.

According to the invention the axis of the ring-like chambers is horizontal or substantially horizontal and in the direction of rotation of the ring-like chambers there is outside the magnetic poles above the level of the balls in the chambers a free space. In such an embodiment is it possible to have a relatively high bed of balls, so that there is a long period of separation and the sharpness of the separation is favourably influenced. The distance of falling of the balls is here as large as possible.

Figure 2:
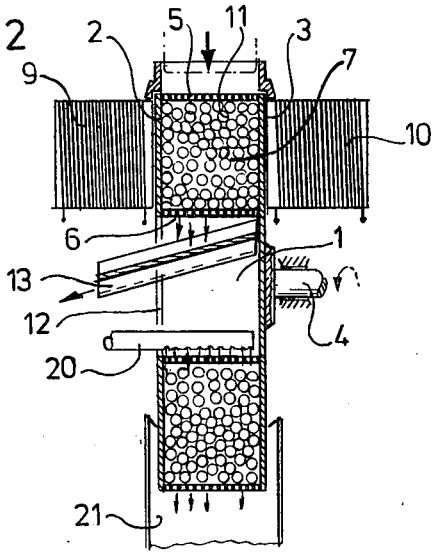

The invention will further be explained in the following description of an embodiment according to the invention shown in the drawing. In the drawing is:

FIG. 1 a cross-section of a device according to the invention,

FIG. 2 a section according to the line II—II in FIG. 1.

The device consists of a wheel 1, which is mainly formed by two discs 2 and 3 which can be driven by means of a shaft 4. The driving takes place through controllable drive means which are not shown. At the inner and outer circumference the wheel 1 is provided with sieve walls 5 and 6. By means of the sieve walls 5 and 6 in the wheel is formed a ring-like chamber 7. The ring-like chamber 7 is filled with ball shaped bodys 8 in shape of iron balls. Near the upper part of the wheel on both sides are provided two strong electromagnets 9 and 10. Between the side discs of the wheel 2 and 3 and the poles of the electromagnets 9 and 10 is an air gap, which is as narrow as possible. In the upper zone 11 of the ring-like chamber 7 a strong magnetic field can be generated by means of the electromagnets 9 and 10. The disc 2 at at the side remote from the driving shaft has in its center an aperture 12. Under the zone 11 is mounted a discharge trough 13 which extends through the aperture 12 to outside the wheel. Above the zone 11 is mounted a hopper 14 for the material to be separated, said material can be supplied as a suspension by means of the trough 16. Above the zone 11 has been provided a supply 17 for washing liquid. Further a spray device 18 has been provided, said spray device lying in rotational direction of the ring-like chamber 7 beyond the zone 11. Near the under side in the zone 19 of the ring-like chamber 7 has been provided inside the wheel a supply pipe 20. Under the zone 19 has been provided a discharge trough 21.

The device functions as follows. The magnets 9 and 10 are energised, so that in the zone 11 is generated a strong magnetic field. The material 15 to be separated is supplied through the trough 16 and the hopper 14. As the material is supplied as a suspension it is distributed over the filling of ball shaped bodies 8 in the ring-like chamber 7. When the material is flowing through the zone 11 the magnetisable particles are retained by the magnetized balls 8. As the ring-like chamber rotates by driving the shaft 4, the balls 8 are stowed in the chamber 7 and are pushed along the poles 9 and 10 in the zone 11. By the pipe 17 washing liquid is added which washes off the non-magnetic particles which are not retained by the balls. The washing liquid with the non-magnetic particles lands in the troughs 13 and is discharged through this trough. When the balls with the attached magnetized particles have passed the zone 11, they reach an open space, in which they fall downwards. A spray device 18 supplies washing liquid which washes off from the balls the particles which are no longer magnetic. The same occurs once more in the lower part of chamber 7 in the zone 19. Here the washing liquid which is supplied by means of the spray device 20 is discharged together with the magnetisable particles through the trough 21. Owing to the presence of the free space beyond the zone 11, so that the balls with the attached particles can fall freely, one gets a completely changed configuration of the balls, so that the remanent magnetism of the balls has no longer influence and the magnetisable particles can be washed off easily. So there is no recirculation to zone 11 of particles which remain attached to the balls.

The invention makes it possible to reach a complete separation.

What I claim is:

1. Method for separating magnetizable and non-magnetic particles suspended in a liquid by discharging the liquid containing these particles downwardly into a magnetic field which extends transversely of the flow of liquid so introduced, supplying a first washing liquid during the passage of the particles through the magnetic field for washing off the non-magnetic particles, supplying a second washing liquid outside the magnetic field for washing off the magnetizable particles, the particles to be separated being guided through a bed of balls of ferromagnetic material, said bed being maintained by and passing transversely through said magnetic field and the balls and the magnetizable particles after leaving the magnetic field being subjected to free fall over some distance.

2. The method of separating magnetizable particles from non-magnetic particles, which comprises the steps of:

(a) providing a closed-loop recirculating path of fixed volume, said path being oriented to have upper and lower regions;

(b) providing a quantity of ferromagnetic bodies within said path but having a packed volume less than said predetermined volume;

(c) imposing a magnetic field transversely through said upper region while packing said bodies within and behind said upper region whereby a substantially empty free-fall space is created beyond said upper region between same and said lower region, into which bodies are slowly displaced to fall freely to and replenish the packed bed behind said upper region;

(d) introducing a liquid containing magnetizable and non-magnetic particles downwardly into said upper region and collecting liquid and non-magnetic particles passing downwardly through said upper region;

(e) passing wash liquid downwardly through said packed bed in said lower region and collecting the wash liquid and magnetizable particles passing downwardly through said lower region.

3. The method as defined in claim 2 including the step of introducing wash liquid into said upper region to enhance the passage of non-magnetic particles downwardly therethrough.

4. The method as defined in claim 3 including the step of introducing wash liquid into said free-fall space.

5. The method of separating magnetizable and non-magnetic particles, comprising the steps of:

(a) confining a quantity of bodies of ferromagnetic material within a chamber defining a closed path having an upper portion leading directly to a lower portion, the quantity of said bodies being insufficient to fill said chamber;

(b) imposing a magnetic field transversely into and substantially horizontally through said upper portion of the chamber and simultaneously transporting said bodies along said closed path transversely through said magnetic field whereby said bodies are detained by said magnetic field to substantially fill the cross section of said chamber as they travel through said magnetic field at said upper portion whereafter they fall freely by gravity to accumulate in said lower portion of the chamber;

(c) introducing a liquid suspension containing magnetic and non-magnetic particles into and downwardly through said upper portion of the chamber while simultaneously introducing washing liquid into and downwardly through said upper portion, and draining off liquid and non-magnetic particles immediately below said upper portion; and (d) introducing washing liquid into said lower portion of the chamber and draining off liquid immediately below said lower portion, said magnetic field having a cross-sectional area encompassing the vertical height of said upper portion of the chamber and extending sufficiently in the direction of said closed path to overhang that region of the chamber within which said bodies freely fall, whereby substantially all of the magnetic particles are discharged into said lower portion of the chamber and are recovered in the liquid drained off in step (d).

6. The method as defined in claim 5 wherein said chamber is annular, the liquid drained off in step (c) is drained off from the central region of such annulus whereas the liquid introduced in step (d) is introduced downwardly within said central region but below the draining off of step (c).

7. Apparatus for separating magnetic and non-magnetic particles which comprises, in combination:

an annular drum having a central opening defining a generally horizontal axis, said drum having inner and outer cylindrical wall surfaces which are perforate and define an unobstructed annular volume;

a quantity of ferromagnetic bodies disposed within said drum but in amount insufficient to fill said volume thereof;

means for establishing a transverse magnetic field across the uppermost region of said drum and means for rotating said drum about said axis whereby said bodies are continuously circulated with said drum to be picked up by said magnetic field at the uppermost region of the drum and then released therefrom to fall freely by gravity into a lower region of the drum;

means for introducing liquid with non-magnetic and magnetizable particles suspended therein into said drum through said outer wall surface and generally within said uppermost region, means for introducing washing liquid into said uppermost region of the drum, and means disposed within said central opening for collecting liquid containing said non-magnetic particles which drain through said inner wall surface;

means for introducing washing liquid into said lower region of the drum; and means for collecting liquid containing said magnetizable particles which drain through said outer wall surface at the lower region of said drum.

8. Apparatus as defined in claim 7 wherein said means for introducing washing liquid into said lower region is located within said central opening.

9. Apparatus as defined in claim 7 wherein said means for introducing washing liquid into said lower region is located above said lower region.

10. Apparatus as defined in claim 7 wherein said means for introducing washing liquid into said lower region is located above said lower region and comprises a first spray device located within said central opening and a second spray device located adjacent that region in which said bodies freely fall.

11. The method of filtering which comprises the steps of:

(a) passing a quantity of bodies of ferromagnetic material to a region of predetermined cross-sectional area while simultaneously imposing a magnetic field transversely through said region whereby the bodies directly affected by said magnetic field tend to remain in and fill the cross-section of said region;

(b) providing a free-fall space beyond said region;

(c) continuously passing bodies toward said region to create a packed bed of such bodies at and behind said region which slowly forces said affected bodies through said magnetic field to fall freely into said free-fall space; and (d) passing material to be filtered downwardly through said affected bodies.

12. The method as defined in claim 11 wherein said packed bed extends from the bottom of said free-fall space to said region.

13. The method as defined in claim 12 including the step of introducing washing liquid downwardly through said packed bed near said bottom of the free-fall space whereby magnetic material carried through said region is washed from said bodies.

14. The method as defined in claim 13 including the step of introducing wash liquid directly into said free-fall space.

15. The method as defined in claim 14 including the step of introducing wash liquid downwardly through said region.

* * * * *